US006567635B2

(12) United States Patent
Livadas et al.

(10) Patent No.: US 6,567,635 B2
(45) Date of Patent: May 20, 2003

(54) APPARATUS AND METHOD FOR AGITATING TONER IN A CONTAINER TO FACILITATE TONER DISPENSING IN AN ELECTROSTATOGRAPHIC PRINTER

(75) Inventors: Jerry E. Livadas, Webster, NY (US); Jan Bares, Webster, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/956,629

(22) Filed: Sep. 20, 2001

(65) Prior Publication Data

US 2003/0053825 A1 Mar. 20, 2003

(51) Int. Cl.[7] ..... G03G 15/08

(52) U.S. Cl. ..... 399/253; 399/258; 399/292

(58) Field of Search ..... 399/222, 292, 399/252–256, 258–263

(56) References Cited

U.S. PATENT DOCUMENTS 3,536,043 A * 10/1970 Eppe et al. ..... 399/292
5,345,297 A * 9/1994 Katakabe et al. ..... 399/263

* cited by examiner

*Primary Examiner*—William J. Royer

(57) ABSTRACT

An apparatus and method for dispensing toner in an electrostatographic printer includes apparatus for agitating toner contained by a relatively large toner container (e.g., 10–25 liters in volume). The apparatus includes a substantially vertically-oriented shaft supporting a blade that operates, as the blade rotates, to drive the contained toner mass upwardly, thereby aerating the mass and preventing compaction during toner dispensing.

12 Claims, 3 Drawing Sheets

APPARATUS AND METHOD FOR AGITATING TONER IN A CONTAINER TO FACILITATE TONER DISPENSING IN AN ELECTROSTATOGRAPHIC PRINTER

CROSS-REFERENCE TO RELATED APPLICATIONS

Reference is made to the commonly assigned U.S. patent application Ser. No. 09/956,630, filed concurrently herewith and entitled "Apparatus and Method for Dispensing Toner".

FIELD OF THE INVENTION

The present invention relates to improvements in methods and apparatus for dispensing fresh toner to an image development station in an electrostatographic copier/printer or the like. More particularly, it relates to apparatus for maintaining toner in a fluidized state to facilitate toner dispensing from relatively large storage containers.

BACKGROUND OF THE INVENTION

In electrostatographic copiers and printers, pigmented thermoplastic particles, commonly known as "toner," are applied to latent electrostatic images to render such images visible. Often, the toner particles are mixed with and carried by somewhat larger particles of magnetic material. During the mixing process, the magnetic carrier particles serve to triboelectrically charge the toner particles to a polarity opposite that of the latent charge image. In use, the development mix is advanced, typically by magnetic forces, from a sump to a position in which it contacts the latent charge image. The relatively strong electrostatic forces associated with the charge image operate to strip the toner from the carrier, causing the toner to remain with the charge image. Thus, it will be appreciated that, as multiple charge images are developed in this manner, toner particles are continuously depleted from the mix and a fresh supply of toner must be dispensed from time-to-time in order to maintain a desired image density. Usually, the fresh toner is supplied from a toner supply bottle mounted upside-down, i.e., with its mouth facing downward, at one end of the image-development apparatus. Under the force of gravity, toner accumulates at the bottle mouth, and a metering device, positioned adjacent the bottle mouth, operates to meter sufficient toner to the developer mix to compensate for the toner lost as a result of image development. Usually, the toner-metering device operates under the control of a toner concentration monitor that continuously senses the ratio of toner to carrier particles in the development mix.

It is well known that toner is a powdery substance that exhibits a considerable degree of cohesiveness and, hence, relatively poor flowability. Since the force of gravity alone does not usually suffice in causing toner to flow smoothly from the mouth of an inverted toner bottle, other supplemental techniques have been used to "coax" the toner from the bottle. For example, flow additives, such as silica and the like, have been added to the mix to reduce the troublesome cohesive forces between toner particles. See, e.g., the disclosure of U.S. Pat. No. 5,260,159 ; in which a "fluidization" agent is added to a developer mix in a development sump to assist the movement of developer therein. While beneficial to a more consistent flow of developer, such substances influence other performance attributes of the development process and their effectiveness is therefore constrained. Automatically operated stirring devices or augers mounted within a horizontally oriented toner container, and thumping or vibrating devices connected to such containers have also been used to urge toner from its rest position towards an outlet or exit port. Such mechanical techniques work well when the toner container is relatively small (e.g., 2 to 5 liters) and the height of the toner column above the exit port is relatively low (e.g., lower than about 15 cm.) so as to avoid gravity-assisted compaction of the toner which further compromises flowability. But, as the size of the toner bottle or container increases, e.g., to accommodate high speed and wide format printing in which toner is consumed at extraordinarily fast rates, the above-noted flow-enhancing techniques have been found to be inadequate. In such high toner-consumption situations, toner sumps of the order of tens of liters are desirable in order to eliminate the need for frequent toner bottle replacements. The weight of the toner in these large volume containers is too great for conventional rappers and vibrators to keep the toner flowing through the outlet, and most of these devices only exacerbate the toner packing problem.

In U.S. Pat. No. 5,570,170, there is disclosed an apparatus for dispensing single-component, electrically conductive magnetic toner particles from a pair of inverted toner bottles mounted above a conventional development station in an electrostatic printing apparatus. A screen positioned at the mouth of each bottle serves to prevent toner flow from the bottle whenever the toner is piled up atop the screen. The toner-dispensing apparatus includes a pair of gas-permeable, but toner-impermeable, tubes that extend upwardly, into each bottle, a distance of about 30–60% of the height of the bottles. On command, pressurized gas is introduced into the tubes. As the gas passes through the tubes and into the toner bottles, it acts to fluidize the toner in the bottle in the vicinity of the bottle's outlet, thereby enabling the toner to flow smoothly through the screen mesh and into the development station of the printer, as needed. In effect, the screen acts as a gate to prevent toner flow into the development station until the toner above the screen is fluidized. A microprocessor controls the application of pressurized gas to each of the bottles, switching from one bottle to the other as one bottle empties. By using two bottles, the machine operator can replace an empty bottle without shutting down the machine.

While the apparatus disclosed in the above patent may be advantageous in some respects in selectively dispensing magnetic toner to an image-development station, it is disadvantageous in that it requires one or more sources of compressed gas in order to effect the necessary fluidization of the toner mass in order to achieve passage of the toner through the metering screen at the mouth of each toner bottle. Further, to prevent toner dust from being blown out of the development station during toner dispensing, a vacuum must be created in the mouth of the development station. This dusting problem can be especially problematic as the size of the toner bottle increases to accommodate high speed and large format printing.

SUMMARY OF THE INVENTION

In view of the foregoing discussion, an object of this invention is to provide an improved method and apparatus for dispensing toner from high tower sumps or hoppers of the type used in high speed and/or high volume printing applications.

In accordance with a preferred embodiment of the invention, there is provided a toner-dispensing apparatus comprising a relatively large (e.g. 25–50 liters), vertically oriented container adapted to receive a fresh supply of toner. The toner container is adapted to be permanently installed within the framework of an electrostatographic printer or the like, and it is shaped somewhat like a funnel, having a lower portion with walls that converge towards a relatively small toner-outlet port in the container's lowest-most portion. Rotatably supported within the toner container is a vertically oriented mechanical agitator that, during rotation, is adapted to break-up any agglomerations or compactions of toner particles in the container and to lift the toner vertically upwards, allowing such particles to settle in the container under the force of gravity. By such an arrangement, the contained toner is maintained in a fluidized or aerated state while toner is dispensed through the toner outlet port. In accordance with a first preferred embodiment, the mechanical agitator includes an auger blade having a plurality of apertures formed therein. The auger blade has a helical configuration and is shaped to advance toner substantially vertically upwards as the blade rotates. Preferably, the apertures are equally spaced apart along the length of the blade and are of a size to enable the lifted toner to easily drop downwardly, through the blade openings in order to maintain the level of toner in the container substantially constant. The auger blade is configured so that its outer edges are closely spaced from the container wall over the effective portion of the container that holds toner. According to a preferred embodiment, the axis of rotation of the auger is slightly displaced from the container's central axis to facilitate break-up of compacted toner particles and to avoid any tendency for a large "slug" of toner to be advanced by the auger rotation.

According to another preferred embodiment, the above-noted mechanical agitator takes the form of a rotatably mounted substantially vertically oriented shaft having a series of radially-extending propeller blades. The blades are shaped so that, during rotation of the shaft, the toner particles are driven upwardly within the container.

In accordance with another aspect of the invention, a method is provided for enhancing the flowability of toner particles through an exit port located in the base of a substantially vertically oriented toner storage hopper. Such method comprises the steps of fluidizing the toner mass above the port by mechanically agitating the mass with propellers or an auger that rotate(s) about a substantially vertical axis within the toner container.

An advantageous technical effect of the invention is that fresh toner can be dispensed with enhanced reliability from a relatively large storage container in which the toner, but for the invention, would most certainly compact from its weight and from internal machine vibrations, and thereby resist movement from the container's outlet port.

The invention and its advantages will become better understood from the ensuing detailed description of preferred embodiments, reference being made to the accompanying drawings in which like reference characters denote like parts.

DETAILED DESCRIPTION OF THE INVENTION

Figure 1:
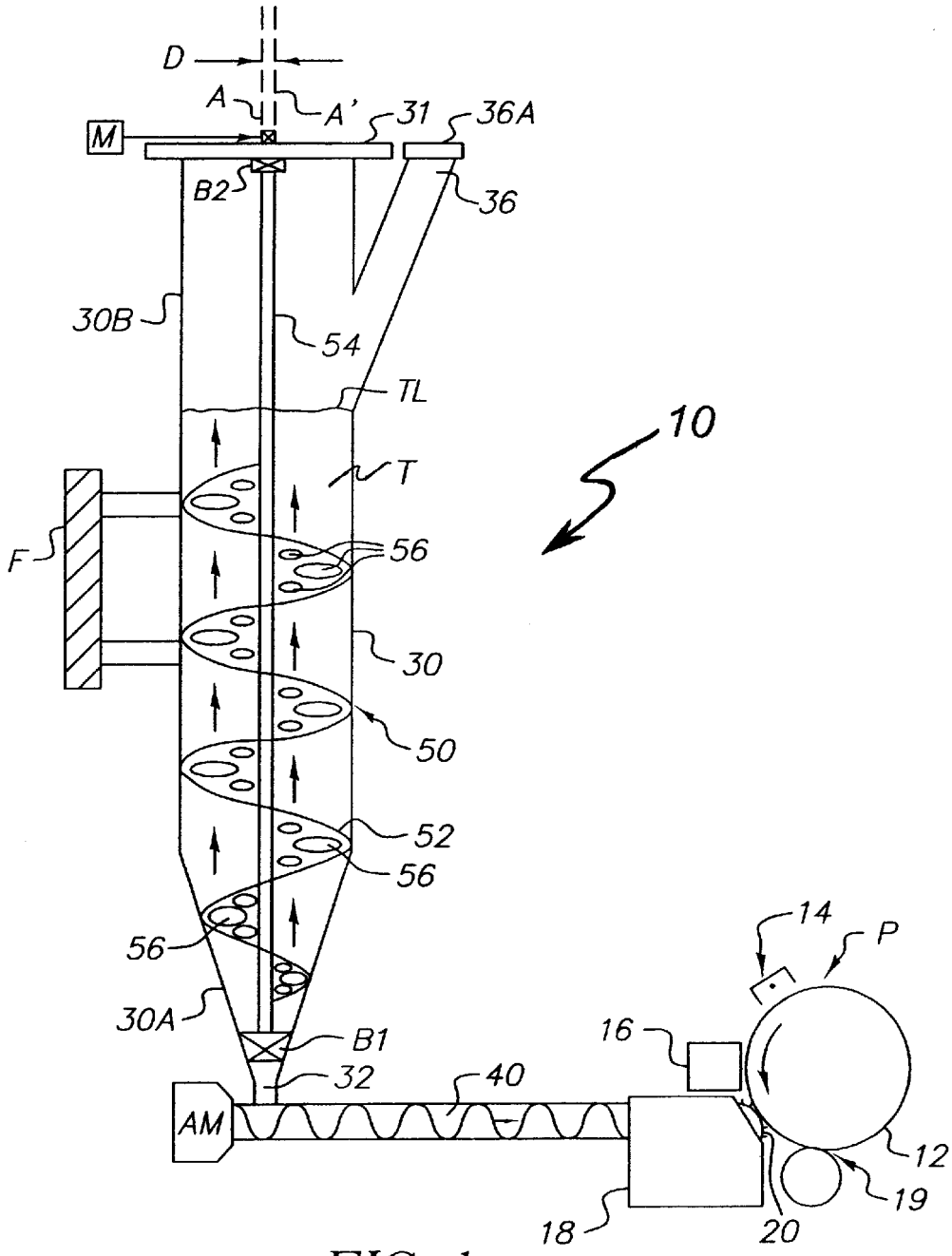
FIGS. 1 and 2 are schematic illustrations of preferred embodiments of the invention.

Referring now to the drawings, FIG. 1 schematically illustrates a preferred embodiment of a toner dispensing apparatus 10 adapted for use with an electrostatographic printer P. The latter is of conventional design comprising, for example, an endless photoconductive recording element 12, typically in the form of a drum, on which electrostatic images are formed by the well-known electrostatographic process. Briefly, such process comprises the steps of uniformly charging the outer surface of the recording element 12 at a primary charging station 14 as the recording element 12 moves therepast, and then, at an exposure station 16, imagewise exposing the uniformly charged surface to actinic radiation adapted to imagewise discharge the charged surface. The charge image thus formed is subsequently rendered visible via the application of toner particles at an image-development station 18. The toned image is then transferred to a receiver sheet at a transfer station 19 and the image-forming process is repeated. The image-development station 18 commonly comprises a rotating "magnetic brush" 20 that operates, in a well known manner, to transport a development mixture of toner and carrier particles from a sump to the surface of the charge image borne by the outer surface of the recording element 12. As noted earlier herein, as the development mixture contacts the charge image, the toner is stripped from the carrier and applied to the charge image. Thus, toner is continuously depleted from the developer and must be replenished.

Still referring to FIG. 1, the toner dispensing apparatus of the invention comprises a relatively large volume (e.g. 25–50 liters), substantially vertically oriented container 30 adapted to receive a fresh supply of toner T. As will be appreciated, such a container is considerably larger (e.g. by a factor of 10 or more) than the volume of conventional toner bottles that are used to replenish toner to conventional document printers and copiers, such bottles being disposable after the contents has been emptied into the developer station sump. Also, the orientation may be at some relatively small angle to the vertical as long as the main component of flow is vertical. In contrast, the toner container 30 is designed to be permanently installed within the housing or frame F of the electrostatographic printer. As illustrated, it is preferred that at least the container's interior wall is shaped somewhat like an elongated funnel, having a cylindrical upper portion 30B and conical lower portion 30A that converges towards a relatively small toner-outlet port 32 in the container's lowest-most portion. Preferably, the container has a substantially circular transverse cross-section. The toner-outlet port 32 is preferably positioned directly above a rotatable auger 40 that serves, when rotated by an auger motor AM, to transport toner from the outlet port 32 of the toner container 30 to the sump housing of image-development station 18. The upper portion of the container 30 defines a normally closed toner-refill port 36 through which fresh toner can be added manually to the container 30 to establish a desired initial toner level TL. Normally, toner-refill port 36 is closed by a cap 36A.

Now, in accordance with the invention, compaction of the toner contained by container 30 as a result of the relatively high vertical column of toner within the container 30 is prevented by a mechanical, toner agitator 50 positioned within the container 30. Preferably, the agitator 50 includes a substantially vertically disposed auger mechanism comprising a rotatably driven, helical auger blade 52 supported by a shaft 54. Details of this auger mechanism are better shown in FIG. 3. Shaft 54 is supported for rotation at opposite ends by a pair of bearings B1, B2 and is rotatably driven by a drive motor M. Bearing B1 is supported by a spider mount that enables toner to flow around and into the container's outlet port 32. Bearing B2 is supported by a lid 31 atop the container 30, the shaft 54 passing through the lid 31 to engage the drive mechanism of drive motor M. Auger blade 52 is contoured such that, as its associated shaft 54 rotates, the auger blade 52 acts to lift the toner within container 30 substantially vertically upwards. A series of suitably sized apertures 56 are formed in the auger blade 52 to enable the lifted toner to fall, under the force of gravity, downwardly into the container 30, thereby maintaining the toner level TL therein substantially constant, at a level determined by the toner consumption of the printer. Preferably, the respective axes A and A' of the shaft 54 and container 30 are not coincident; rather, these axes, though extending parallel to each other, are displaced by a relatively small distance D of up to about 2 or 3 mm. Such a spacing represents a trade-off that serves to maintain a sufficiently close relationship between the container wall and the outer edge of the auger blade 52 to prevent a significant portion of toner from stagnating within the container 30 while, at the same time, preventing any tendency for the rotating auger blade 52 to advance the toner upwardly as a sizable "slug" of non-aerated material within the container 30. This non-concentric relationship assures that the auger blade 52 constantly mixes the toner mass as it elevates it.

Figure 3:
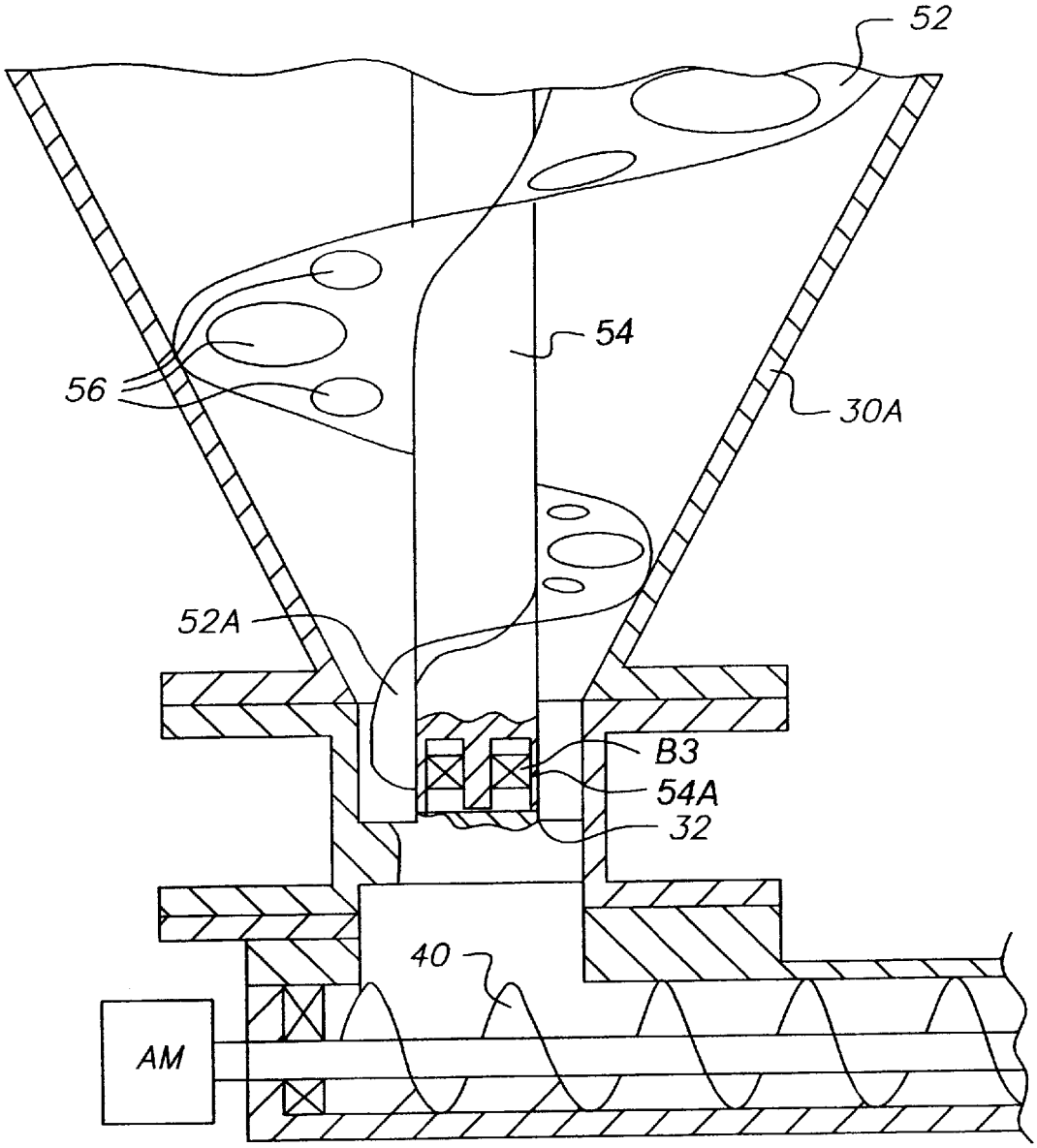
FIG. 3 is an enlarged view showing certain details of the FIG. 1 embodiment.

As shown in FIG. 3, it is preferred that the auger shaft 54 terminates in a flange or skirt 54A that surrounds and protects the bearing B3. Further preferred is that the auger blade 52 has a surface-sweeping paddle portion 52A that operates, while the auger blade 52 is rotating, to sweep particulate material from the wall of outlet port 32 and thereby maintains the port relatively clean at all times.

Figure 2:
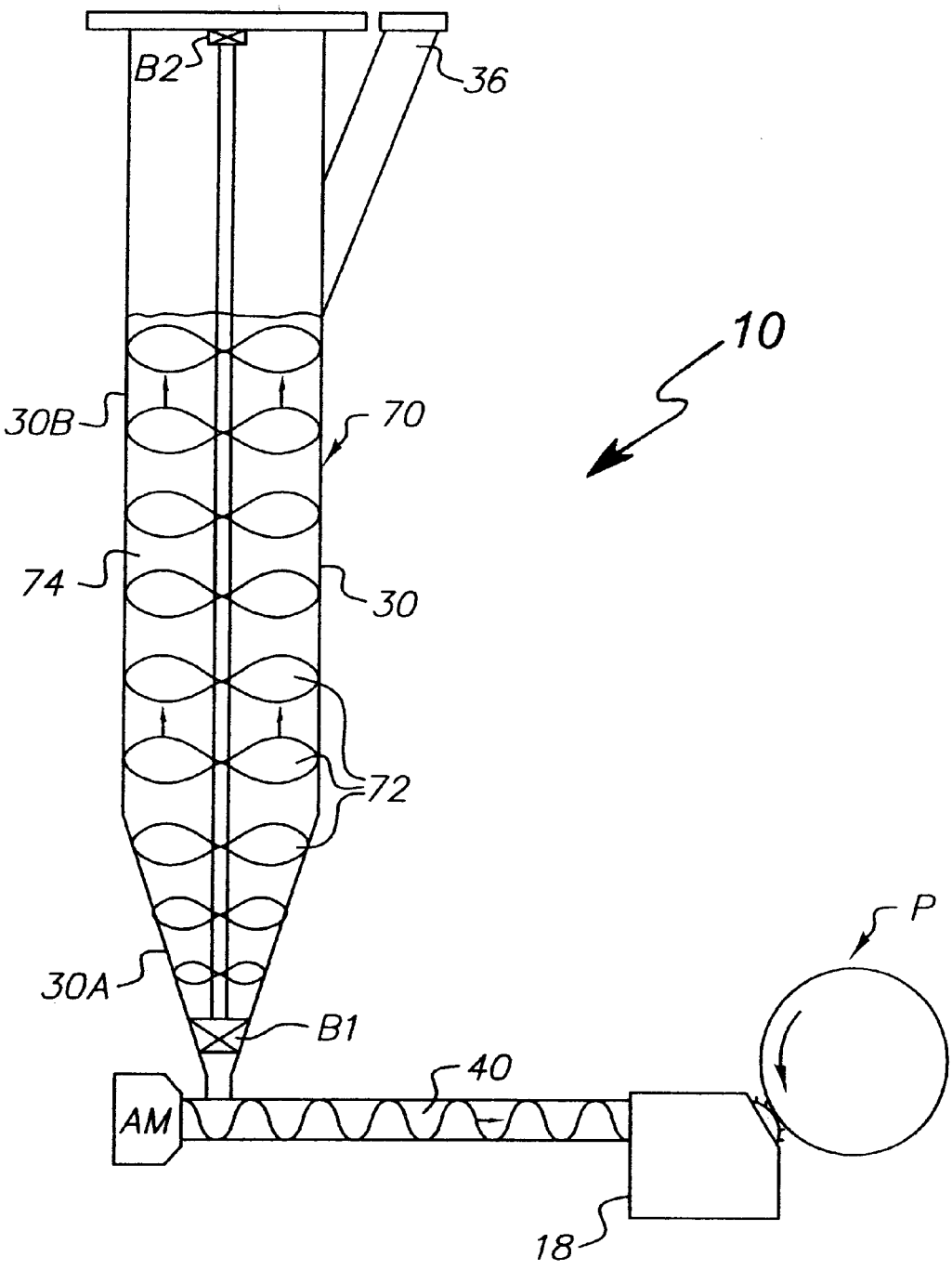

In an alternative embodiment shown in FIG. 2, the auger mechanism of FIG. 1 is replaced by a propeller arrangement 70 in which a series of propellers 72 extend radially outward from a rotatably mounted and driven drive shaft 74. Each of the propellers 72 is suitably shaped and pitched to lift and propel toner particles upwardly within the container 30.

As a result of the above-described construction, the aforementioned disadvantages of the prior art are avoided. Specifically, fresh toner can be dispensed with enhanced reliability from a relatively large storage container 30 in which the toner, but for the invention, would most certainly compact from its weight and from internal machine vibrations, and thereby resist movement from the container's outlet port 32.

While the invention has been described in detail with reference to preferred embodiments, it will be understood that changes can be made without departing from the spirit of the invention. For example, while it is preferred that the respective axes of shaft 54 be offset from each other for reasons expressed above, it is contemplated that the same effect can be achieved by employing a container 30 having a slightly elliptical cross-section, in which case the container and shaft axes may coincide. Such changes are intended to fall within the scope of the following claims.

What is claimed is:

1. Apparatus for dispensing toner in an electrostatographic printer, said apparatus comprising:

(a) a substantially vertically oriented container for containing a fresh supply of toner, said container being adapted to be permanently mounted within a housing of said electrostatographic printer and having a lower portion defined by walls that converge towards a toner-outlet port;

(b) a toner agitator for breaking-up any agglomerations or compactions of toner particles in the container and for lifting the toner upwards, allowing such particles to settle in the container under the force of gravity, said agitator comprising a substantially vertically oriented, rotatably mounted elongated shaft positioned within said container, said shaft supporting at least one blade member adapted to advance toner upwardly in said container as said shaft rotates; and (c) a motor for selectively rotating said shaft.

2. The apparatus as defined by claim 1 wherein a portion of said container has an interior wall having a cylindrical shape, and wherein said at least one blade member comprises an auger blade helically wound about said shaft, said auger blade having an outer edge that extends in close proximity to said cylindrically shaped container wall.

3. The apparatus as defined by claim 2 wherein said auger blade has a plurality of apertures formed therein to enable toner lifted by said auger blade during rotation of said elongated shaft to settle under the influence of gravity into said container.

4. The apparatus as defined by claim 3 wherein said apertures are uniformly spaced over at least a portion of said auger blade.

5. The apparatus as defined by claim 3 wherein said elongated shaft has a central axis that is parallel to and spaced from an axis extending through the center of said container.

6. The apparatus as defined by claim 5 wherein the spacing between said axes is up to about 3 mm.

7. The apparatus as defined by claim 1 wherein said at least one blade member comprises a propeller blade contoured to lift toner in said container as said shaft rotates.

8. The apparatus as defined by claim 1 wherein said shaft is rotatably supported at opposite ends by a pair of bearings mounted within said container.

9. The apparatus as defined by claim 1 further comprising a selectively energizable toner transport device positioned directly below said toner-outlet port, said toner transport device operating, when energized, to transport toner that has passed through said toner-outlet port to an image-development station of said electrostatographic printer.

10. A method for enhancing the flowability of toner particles through an toner-outlet port located in the base of a substantially vertically oriented toner storage container, said method comprising the steps of supporting a toner mass within said container and aerating the toner mass above said toner-outlet port by rotating a toner-agitating member within said container, said member being adapted to lift said toner mass within said container and allow the lifted toner to settle under the influence of gravity.

11. The method as defined by claim 10 wherein said member comprises a rotatably driven auger blade having a plurality of apertures therein to enable lifted toner to settle downwardly through said apertures.

12. The method as defined by claim 10 wherein said member comprises a substantially vertically-oriented and rotatably-driven shaft supporting a plurality of propeller blades contoured to propel the toner upwardly as said shaft rotates.

* * * * *